US009492905B2

(12) United States Patent
Chen et al.

(10) Patent No.: US 9,492,905 B2
(45) Date of Patent: Nov. 15, 2016

(54) RETAINING RING WITH SELECTED STIFFNESS AND THICKNESS

(71) Applicant: Applied Materials, Inc., Santa Clara, CA (US)

(72) Inventors: Hung Chih Chen, Sunnyvale, CA (US); Samuel Chu-Chiang Hsu, Palo Alto, CA (US); Gautam Shashank Dandavate, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 38 days.

(21) Appl. No.: 14/679,817

(22) Filed: Apr. 6, 2015

(65) Prior Publication Data

US 2015/0209930 A1 Jul. 30, 2015

Related U.S. Application Data

(63) Continuation of application No. 13/661,603, filed on Oct. 26, 2012, now Pat. No. 8,998,676.

(51) Int. Cl.

| | |
|---|---|
| ***B24B 37/27*** | (2012.01) |
| ***B24B 37/32*** | (2012.01) |
| ***B24B 7/00*** | (2006.01) |
| ***B24B 7/22*** | (2006.01) |

(52) U.S. Cl.

CPC ..... *B24B 37/32* (2013.01); *B24B 7/00* (2013.01); *B24B 7/228* (2013.01)

(58) Field of Classification Search

CPC ..... B24B 7/241; B24B 7/228; B24B 37/32; B24B 7/00

USPC ..... 451/28, 285–289

See application file for complete search history.

(56) References Cited

U.S. PATENT DOCUMENTS

| | | | | |
|---|---|---|---|---|
| 5,738,574 | A | 4/1998 | Tolles | |
| 6,143,127 | A | 11/2000 | Perlov et al. | |
| 6,251,215 | B1 | 6/2001 | Zuniga et al. | |
| 6,540,592 | B1 | 4/2003 | Schultz et al. | |
| 6,893,327 | B2 | 5/2005 | Kajiwara et al. | |
| 7,094,133 | B2 | 8/2006 | Masunaga et al. | |
| 7,575,504 | B2 | 8/2009 | Zuniga et al. | |
| 8,088,299 | B2 | 1/2012 | Chen et al. | |
| 8,998,676 | B2 * | 4/2015 | Chen | B24B 7/228 451/28 |
| 2002/0164926 | A1 | 11/2002 | Simon | |
| 2002/0173242 | A1 | 11/2002 | Wang et al. | |
| 2002/0173255 | A1 | 11/2002 | Shendon et al. | |
| 2004/0005842 | A1 | 1/2004 | Chen et al. | |

(Continued)

OTHER PUBLICATIONS

International Search Report and Written Opinion in International Application No. PCT/US2013/065320, mailed on Jan. 29, 2014, 10 pages.

*Primary Examiner* — George Nguyen

(74) *Attorney, Agent, or Firm* — Fish & Richardson P.C.

(57) ABSTRACT

A retaining ring for holding a substrate below a carrier head during chemical mechanical polishing includes an annular lower portion and an annular upper portion secured to the lower portion. The annular lower portion has a main body with a bottom surface for contacting a polishing pad during polishing, and is a first material. A top surface of the upper portion is configured to be secured to the carrier head. The upper portion is a second material that is more rigid than the first material. A thickness and stiffness of the lower portion is selected for a particular polishing environment to improve polishing uniformity near an edge of the substrate.

10 Claims, 1 Drawing Sheet

(56) References Cited

U.S. PATENT DOCUMENTS

2004/0123951 A1 7/2004 Kramer et al.
2004/0209556 A1 10/2004 Zuniga et al.
2005/0113002 A1* 5/2005 Chen ..... B24B 37/32 451/42
2006/0128277 A1 6/2006 Maloney et al.
2008/0171500 A1* 7/2008 Kuwabara ..... H01L 21/3212 451/398
2010/0099334 A1 4/2010 Bennett et al.
2012/0018093 A1 1/2012 Zuniga et al.
2012/0071067 A1 3/2012 Chen et al.
2013/0035022 A1* 2/2013 Paik ..... B24B 37/32 451/364

* cited by examiner

RETAINING RING WITH SELECTED STIFFNESS AND THICKNESS

CROSS-REFERENCE TO RELATED APPLICATIONS

This application is a continuation application of and claims priority to U.S. application Ser. No. 13/661,603, filed on Oct. 26, 2012, the entire contents of which are incorporated by reference.

TECHNICAL FIELD

The present disclosure relates to a retaining ring for a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as slurry with abrasive particles, is typically supplied to the surface of the polishing pad.

The substrate is typically retained below the carrier head by a retaining ring. Some retaining rings include an upper metal portion and a lower plastic portion.

SUMMARY

The geometry of the bottom surface of a retaining ring can impact the pressure distribution on the substrate near the substrate edge, and thus affect the polishing uniformity. However, the stiffness and height of the lower plastic portion of the retaining ring can also impact the pressure distribution near the substrate edge. By selecting a combination of stiffness and height of the lower plastic portion of the retaining ring, pressure uniformity can be improved.

In one aspect, a retaining ring for holding a substrate below a carrier head during chemical mechanical polishing includes an annular lower portion and an annular upper portion secured to the lower portion. The annular lower portion has a main body with a bottom surface for contacting a polishing pad during polishing, and is a first material. A top surface of the upper portion is configured to be secured to the carrier head. The upper portion is a second material that is more rigid than the first material. A thickness and stiffness of the lower portion is selected for a particular polishing environment to improve polishing uniformity near an edge of the substrate.

Implementations may include one or more of the following features. The first material may be a plastic and the second material may be a metal. The lower portion may have a flexural modulus of about 0.5 to $1.5\times10^6$ psi. The lower portion may have a thickness of 25 to 50 mils.

In another aspect, a retaining ring for holding a substrate below a carrier head during chemical mechanical polishing includes an annular lower portion and an annular upper portion secured to the lower portion. The annular lower portion has a main body with a bottom surface for contacting a polishing pad during polishing. The annular lower portion has a thickness between 5 and 45 mils and is a first material having a flexural modulus between 1.1 and $1.5\times10^6$ psi. A top surface of the upper portion is configured to be secured to the carrier head. The upper portion is a second material that is more rigid than the first material.

Implementations may include one or more of the following features. The annular lower portion may have a thickness between 10 and 20 mils. The annular lower portion may have a thickness between 25 and 45 mils.

In another aspect, a method of selecting a retaining ring includes polishing a first test substrate with the first test substrate held in a carrier head having a first retaining ring having an upper portion and a lower portion with a first stiffness and a first thickness, measuring polishing uniformity of the first test substrate, selecting based on the polishing uniformity a second retaining ring with an upper portion and a lower portion with a second stiffness and a second thickness, polishing a second test substrate with the second test substrate held in the carrier head having the second retaining ring, and polishing a plurality of device substrates using a plurality of carrier heads having a plurality of retaining rings, each retaining ring of the plurality of retaining rings having an upper portion and a lower portion with a second stiffness and the second stiffness.

Implementations may include one or more of the following features. Measuring polishing uniformity may include determining that a perimeter portion of the first test substrate is overpolished relative to a center portion of the first test substrate, and the second hardness may be greater than the first hardness and/or the second thickness may be less than the first thickness. Measuring polishing uniformity may include determining that a perimeter portion of the first test substrate is underpolished relative to a center portion of the first test substrate, and the second hardness may be less than the first hardness and/or the second thickness may be greater than the first thickness.

Advantages of implementations may include one or more of the following. Pressure uniformity can be improved, and within-wafer non-uniformity (WIWNU) can be reduced.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

During a polishing operation, one or more substrates can be polished by a chemical mechanical polishing (CMP) apparatus that includes a carrier head 100. A description of a CMP apparatus can be found in U.S. Pat. No. 5,738,574.

Figure 1:
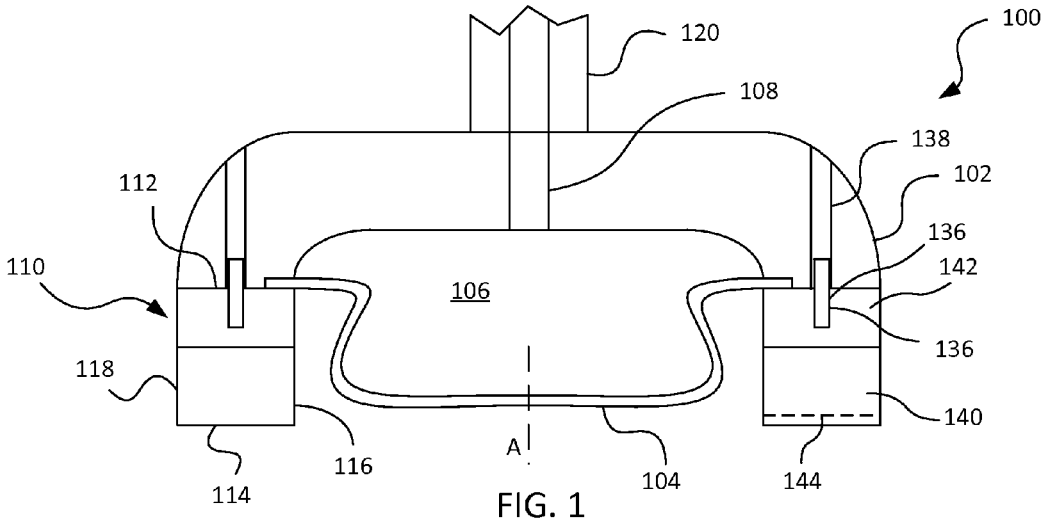
FIG. 1 is a schematic cross-sectional view of a carrier head.

Referring to FIG. 1, an exemplary simplified carrier head 100 includes a housing 102, a flexible membrane 104 that provides a mounting surface for the substrate, a pressurizable chamber 106 between the membrane 104 and the housing 102, and a retaining ring 110 secured near the edge of the housing 102 to hold the substrate below membrane 104. Although FIG. 1 illustrates the membrane 104 as clamped between the retaining ring 110 and the base 102, one or more other parts, e.g., clamp rings, could be used to hold the membrane 104. A drive shaft 120 can be provided to rotate and/or translate the carrier head across a polishing pad. A pump may be fluidly connected to the chamber 106 though a passage 108 in the housing to control the pressure in the chamber 106 and thus the downward pressure of the flexible membrane 104 on the substrate.

The retaining ring 110 may be a generally annular ring secured at the outer edge of the base 102, e.g., by screws or bolts 136 that extend through passages 138 in the base 102 into aligned threaded receiving recesses 139 (see FIG. 2) in the upper surface 112 of the retaining ring 110. In some implementations, the drive shaft 120 can be raised and lowered to control the pressure of a bottom surface 114 of the retaining ring 110 on a polishing pad. Alternatively, the base 102 can be movable relative to the drive shaft 120, e.g., a housing can be connected the drive shaft and the carrier head 100 can include an internal chamber which can be pressurized to control a downward pressure on the base, e.g., as described in U.S. Pat. No. 6,183,354, which is incorporated by reference. Alternatively, the retaining ring 110 can be movable relative to the base 120 and the carrier head 100 can include an internal chamber which can be pressurized to control a downward pressure on the retaining ring, e.g., as described in U.S. Pat. No. 7,575,504, which is incorporated by reference.

The retaining ring 110 can be removable from the base 102 (and the rest of the carrier head) as a unit. This means that an upper portion 142 of the retaining ring 110 remains secured to a lower portion 140 of the retaining ring while the retaining ring 110 is removed, without requiring disassembly of the base 102 or removal of the base 102 from the carrier head 100.

An inner surface 116 of retaining ring 110 defines, in conjunction with the lower surface of the flexible membrane 104, a substrate receiving recess. The retaining ring 110 prevents the substrate from escaping the substrate receiving recess.

Figure 2:
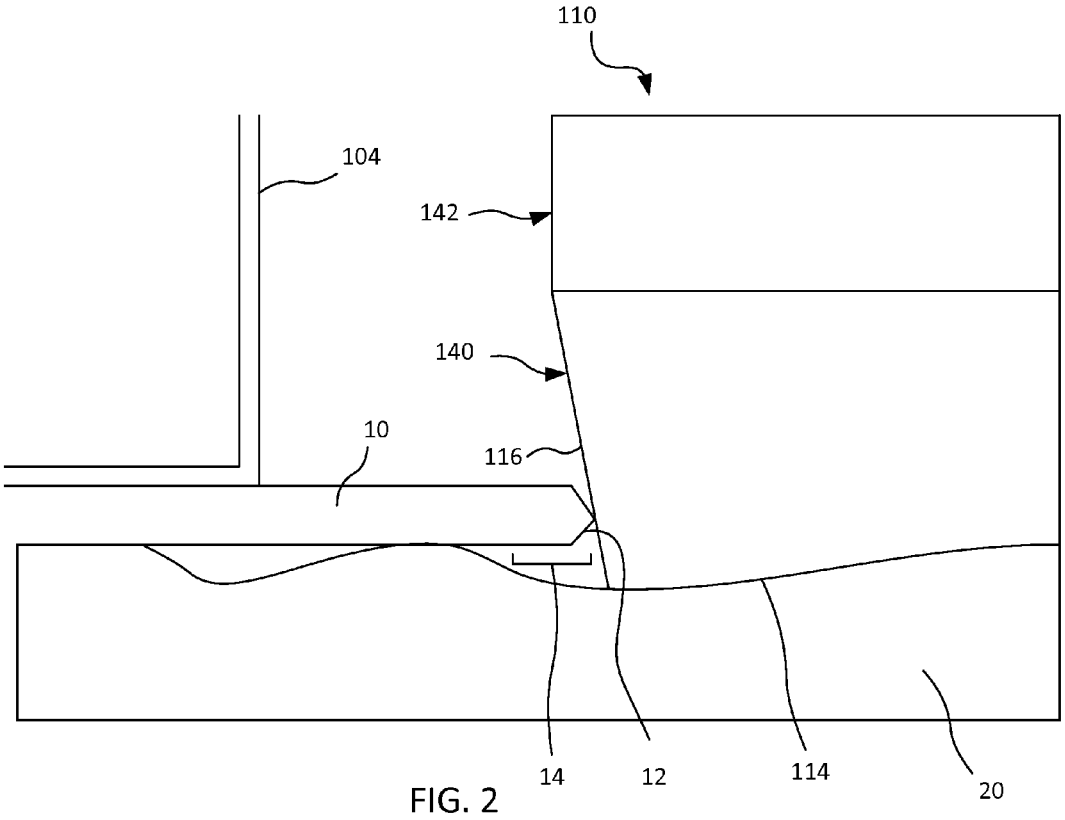
FIG. 2 is a schematic expanded cross-sectional view of a substrate being held by a retaining ring.

Referring to FIGS. 1-2, the retaining ring 110 includes two vertically stacked sections, including the annular lower portion 140 having the bottom surface 114 that may contact the polishing pad, and the annular upper portion 142 connected to base 104. The lower portion 140 can be secured to the upper portion 142 with an adhesive, e.g., epoxy, or with mechanical fasteners 144, e.g., screws or bolts. The retaining ring 110 is structured so that there is no passage between the upper surface 112 and the bottom surface 114. In some implementations, the passages 138 can extend partially but not entirely through the upper portion 142. In some implementations, the passages 138 can extend through the upper portion 142 and into, but not through, the lower portion 140.

The upper portion 142 of retaining ring 110 is composed of a more rigid material than the lower portion 140. The lower portion 140 can be a plastic, whereas the upper portion can be a metal, e.g., stainless steel or aluminum, or a ceramic material. An advantage of having the material of the upper portion 142 be harder than the material of the lower portion 140 is that the overall rigidity of the retaining ring 110 can be increased, thus reducing deformation of the lower portion 140 when the retaining ring 110 is attached to the carrier head 100, and reducing break-in time.

The material of the lower portion 140 is chemically inert in a CMP process. In addition, lower portion 140 should be sufficiently elastic that contact of the substrate edge against the retaining ring does not cause the substrate to chip or crack. On the other hand, lower portion 140 should be sufficient rigid to have sufficient lifetime under wear from the polishing pad (on the bottom surface) and substrate (on the inner surface).

The bottom surface 114 of the retaining ring 110 can be substantially flat, or in some implementations it may have a plurality of channels 144 that extend from the inner surface 116 to the outer surface 118 of the retaining ring to facilitate the transport of slurry from outside the retaining ring to the substrate. The channels 144 can be evenly spaced around the retaining ring. In some implementations, each channel 144 can be offset at an angle, e.g., 45°, relative to the radius passing through the channel. The channels on the lower surface 114 extend partially into, not entirely through, the lower portion 140. The retaining ring 110 can be replaced when lower portion 140 has been sufficiently worn. As ring wears, the total ring thickness decreases and the membrane becomes more compressed, which can affect load on the substrate edge. The retaining ring 110 can be replaced after a certain reduction in thickness, e.g., 0.09 inches of wear. In addition, the impact of the substrate can cause damage or wear to the inner surface 116 of the retaining ring. Moreover, the retaining ring 110 can be refurbished by removing the worn lower portion 140 and attaching a new lower portion to the upper portion 142.

The flexural modulus of the material of the lower portion can be in the range of 0.5 to $1.5\times10^6$ psi. In some implementations, the flexural modulus of the material of the lower portion can be in the range of 1.1 to $1.5\times10^6$ psi, e.g., about $1.2\times10^6$ psi. Although the lower portion can have a low wear rate, it is acceptable for the lower portion 140 to be gradually worn away, as this appears to prevent the substrate edge from cutting a deep grove into the inner surface 144.

The plastic of the lower portion 140 may be (e.g., consist of) a "self-reinforced plastic", which is a polymer matrix reinforced by commonly oriented polymer fibers, which can be derived from the same polymer as the matrix. The plastic can be self-reinforced polyphenylene or polypropylene, e.g., PrimoSpire PR120 from Solvay Plastics. Other possible materials for the lower portion 140 include polyphenylene sulfide (PPS), polyetheretherketone (PEEK), polyetherketoneketone (PEKK), polyetherketone (PEK), or a similar material.

Adjacent the bottom surface 114, the inner surface 116 of the lower portion 140 of the retaining ring can have an inner diameter just larger than the substrate diameter, e.g., about 1-2 mm larger than the substrate diameter, so as to accommodate positioning tolerances of the substrate loading system. The retaining ring 110 can have a radial width of about half an inch to an inch. The inner surface 116 of the lower portion 140 can be substantially vertical. Similarly, the inner surface 116 of the upper portion 140 can be substantially vertical.

The thickness of the lower portion 140 should be larger than the permissible wear of the ring before replacement. On the other hand, if the lower portion is too thick, the bottom surface of the retaining ring 110 will be subject to deformation due to the flexible nature of the lower portion 140. The initial thickness T of the lower portion 140 may be about 25 to 100 mils, e.g., 50 mils. In some implementations, the initial thickness T of the lower portion 140 may be 25 to 45 mils.

In implementations with channels, the channels 144 can have a depth of 50-90%, e.g., 80%, of the thickness of the lower portion 140, e.g., 25 to 45 mils. For example, for a 50 mil thick lower portion 140, the channels can be about 40 mils deep. Alternatively, the channels can extend entirely though the retaining ring, can even extend into the upper portion 142.

In operation, the frictional force of the polishing pad 20 against the substrate 10 forces the substrate 10 toward the "trailing edge" of the carrier head 100, i.e., in the same direction as the rotation of the polishing pad 20. This drives an edge 12 of the substrate 10 against the inner surface 116 of the bottom portion 140. In addition, there is a frictional force from the polishing pad 20 on the lower surface 114 of the retaining ring 110. The combination of these forces tends generate a local torque on the lower portion 140, causing the inner surface 116 lower surface 114 to deform. As shown in FIG. 2, the deformation and result in the inner surface 116 being sloped outwardly (relative to the center of the retaining ring) along a downward direction.

The deformation of the lower portion 140 of the retaining ring under the influence of the lateral forces during polishing creates a compression in the polishing pad 20, which affects the pressure on the a perimeter portion 14 of the lower surface of the substrate 10, and thus the polishing rate near the substrate edge 12. In general, the greater the deformation, the greater the polishing rate in the perimeter portion 14.

In general, the more rigid the material of the lower portion 140, the less the lower portion 140 will deform. In addition, the thinner the lower portion 140, the less the moment, and the less the lower portion 140 will deform.

By proper selection of the combination of the stiffness and thickness of the lower portion 140 of the retaining ring, the compression distribution within the polishing pad 20, and thus the pressure on the perimeter portion 14 of the substrate 10, can be tuned. In particular, by reducing the thickness of the lower portion 140, the moment of the lower portion 140 about the interface between the upper portion 142 and the lower portion 140 can be reduced, resulting in less deflection of the lower portion 140 into the polishing pad, and a slower edge removal rate.

For a polishing process using a low-abrasive slurry, wear of the retaining ring will tend to decrease. However, low-abrasive slurries have a greater tendency to suffer from the edge effect. Thus, a polishing process using a low-abrasive slurry can particularly benefit from this technique, as the lower portion 140 can be thinner without significant loss of retaining ring lifetime, while improving polishing uniformity at the substrate edge.

In order to select the stiffness and thickness of the lower portion 140, a first test substrates can be polished, with a first retaining ring with a first stiffness and a first thickness installed on the carrier head 100. Polishing of the first test substrate can otherwise be conducted using the same polishing recipe is expected to be used for product substrates. The amount of material removed from the first test substrate can be measured at different radial positions, e.g., using a stand-alone metrology system. Whether the first test substrate perimeter is overpolished or underpolished relative to the center of the first test substrate can be determined.

A second retaining ring with a second stiffness and a second thickness is selected based on the measured degree of overpolishing or underpolishing of the first test substrate. For example, if the test substrate perimeter is overpolished, a second retaining ring with a stiffer and/or thinner lower portion 140 (relative to the first retaining ring) is selected. Similarly, if the test substrate perimeter is underpolished, a second retaining ring with a softer and/or thicker lower portion 140 (relative to the first retaining ring) is selected.

In some implementations, a second test substrate is be polished with the second retaining ring. Whether the second test substrate perimeter is overpolished or underpolished relative to the center of the second test substrate can be determined. If the second test substrate has an acceptable polishing uniformity, polishing of device substrates can be conducted using retaining rings with the second hardness and second thickness. On the other hand, so long as a test substrate has unacceptable non-uniformity, the process of selecting another retaining ring and polishing another test substrate can be iterated until an acceptable or maximum degree of polishing uniformity is achieved.

Optionally an annular recess that extends entirely around the retaining ring 110 can be formed on the top surface 112 of the upper portion 142. An O-ring can fit into the annular recess. When the retaining ring 110 is secured to the carrier head 100, the O-ring is compressed between the rigid body to which the retaining ring is attached, e.g., the base 102, and the retaining ring 110. This can help prevent slurry from reaching the interior of the carrier head, thereby potentially reducing corrosion and associated defects.

In some implementations, the retaining ring 110 has one or more through holes that extend horizontally or at a small angle from horizontal through the body of the retaining ring from the inner surface 116 to the outer surface 118 for allowing fluid, e.g., air or water, to pass from the interior to the exterior, or from the exterior to the interior, of the retaining ring during polishing. The through-holes can extend through the lower portion 140. The through holes can be evenly spaced around the retaining ring.

Rather attach the lower portion 140 to the upper portion 142 with mechanical fasteners or adhesive, the lower portion 140 could be plastic coating sprayed onto the upper portion 142. The coating can cover the lower surface and the side surfaces of the upper portion 142. The thickness of the lower portion 140 can be about 0.02 inches. Such an implementation may be suitable for some polishing recipes that use low abrasive slurries, e.g., with a low-abrasive slurry the ring may undergo vertical wear of about 0.01 inches before wear or damage to the ring inner diameter becomes too severe and the retaining ring needs to be replaced.

The present invention has been described in terms of a number of embodiments. The invention, however, is not limited to the embodiments depicted and described. Rather, the scope of the invention is defined by the appended claims.

What is claimed is:

1. A retaining ring for holding a substrate below a carrier head during chemical mechanical polishing, comprising:

an annular lower portion having a main body with a bottom surface for contacting a polishing pad during polishing, the annular lower portion having a thickness between 5 and 45 mils and being a first material having a flexural modulus between 1.1 and $1.5\times10^6$ psi; and an annular upper portion secured to the lower portion, a top surface of the upper portion configured to be secured to the carrier head, the upper portion being a second material that is more rigid than the first material.

2. The retaining ring of claim 1, wherein the annular lower portion has a thickness between 10 and 20 mils.

3. The retaining ring of claim 1, wherein the annular lower portion has a thickness between 25 and 45 mils.

4. The retaining ring of claim 1, wherein the first material is a plastic and the second material is a metal or ceramic.

5. The retaining ring of claim 4, wherein the plastic is a polymer matrix reinforced by commonly oriented polymer fibers.

6. The retaining ring of claim 5, wherein the polymer fibers are derived from the same polymer as the matrix.

7. The retaining ring of claim 4, wherein the plastic comprises polyphenylene or polypropylene.

8. The retaining ring of claim 4, wherein the second material is stainless steel or aluminum.

9. The retaining ring of claim 1, wherein the flexural modulus is about $1.2\times10^6$ psi.

10. The retaining ring of claim 1, wherein the annular lower portion comprises a plurality of slurry transport channels, the channels having a depth of 50-90% of the thickness of the lower portion.

* * * * *